US010883487B2

(12) United States Patent
Mou et al.

(10) Patent No.: US 10,883,487 B2
(45) Date of Patent: Jan. 5, 2021

(54) MICRO-ELECTROMECHANICAL FLUID CONTROL DEVICE

(71) Applicant: Microjet Technology Co., Ltd., Hsinchu (TW)

(72) Inventors: Hao-Jan Mou, Hsinchu (TW); Ta-Wei Hsueh, Hsinchu (TW); Ying-Lun Chang, Hsinchu (TW); Rong-Ho Yu, Hsinchu (TW); Cheng-Ming Chang, Hsinchu (TW); Hsien-Chung Tai, Hsinchu (TW); Wen-Hsiung Liao, Hsinchu (TW); Yung-Lung Han, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 195 days.

(21) Appl. No.: 16/053,195

(22) Filed: Aug. 2, 2018

(65) Prior Publication Data

US 2019/0063417 A1 Feb. 28, 2019

(30) Foreign Application Priority Data

Aug. 31, 2017 (TW) ..... 106129652 A

(51) Int. Cl.
*F04B 43/04* (2006.01)
*F04B 53/20* (2006.01)
*F04B 45/047* (2006.01)

(52) U.S. Cl.
CPC ..... *F04B 43/046* (2013.01); *F04B 45/047* (2013.01); *F04B 53/20* (2013.01)

(58) Field of Classification Search
CPC ..... F04D 43/046; F04D 45/47; F04D 53/20
See application file for complete search history.

(56) References Cited

U.S. PATENT DOCUMENTS

2010/0265301 A1* 10/2010 Takakuwa ..... B41J 2/1645 347/71
2010/0310398 A1* 12/2010 Janse Van Rensburg ..... F04B 43/04 417/488

(Continued)

FOREIGN PATENT DOCUMENTS

CN 103026066 A 4/2013
CN 103781630 A 5/2014

(Continued)

OTHER PUBLICATIONS

Extended European Search Report, dated Dec. 21, 2018, for European Application No. 18186993.4.

*Primary Examiner* — Connor J Tremarche
(74) *Attorney, Agent, or Firm* — Birch, Stewart, Kolasch & Birch, LLP

(57) ABSTRACT

A micro-electromechanical fluid control device includes at least one flow guiding unit. The at least one flow guiding unit includes an inlet plate, a substrate, a resonance membrane, an actuating membrane and an outlet plate sequentially stacked. A first chamber is defined between the resonance membrane and the actuating membrane and a second chamber is defined between the actuating membrane and the outlet plate. While the piezoelectric membrane of the flow guiding unit drives the actuating membrane, a fluid is inhaled into the convergence chamber via the inlet of the inlet plate, transported into the first chamber via the central aperture of the resonance membrane, transported into the second chamber via a vacant space of the actuating membrane, and discharged out from the outlet of the outlet plate, so as to control the fluid to flow.

8 Claims, 9 Drawing Sheets

(56) References Cited

U.S. PATENT DOCUMENTS

| | | | | |
|---|---|---|---|---|
| 2011/0186765 | A1* | 8/2011 | Jaeb | F04B 43/046 251/331 |
| 2013/0058819 | A1* | 3/2013 | Kodama | F04B 43/043 417/479 |
| 2013/0276906 | A1* | 10/2013 | Locke | F04B 43/043 137/15.01 |
| 2014/0270271 | A1* | 9/2014 | Dehe | B81B 3/0018 381/174 |
| 2015/0150470 | A1 | 6/2015 | Sano et al. | |

FOREIGN PATENT DOCUMENTS

| | | | |
|---|---|---|---|
| CN | 106030108 | A | 10/2016 |
| CN | 205744376 | U | 11/2016 |
| EP | 2568177 | A1 | 3/2013 |
| JP | 2009-97414 | A | 5/2009 |
| TW | 200612589 | A | 4/2006 |
| WO | WO 2014/024608 | A1 | 2/2014 |
| WO | WO 2016/175185 | A1 | 11/2016 |

* cited by examiner

MICRO-ELECTROMECHANICAL FLUID CONTROL DEVICE

FIELD OF THE DISCLOSURE

The present disclosure relates to a micro-electromechanical fluid control device, and more particularly to a miniature, thin and mute micro-electromechanical fluid control device.

BACKGROUND OF THE DISCLOSURE

Currently, in all fields, the products used in many sectors such as pharmaceutical industries, computer techniques, printing industries or energy industries are developed toward elaboration and miniaturization. The fluid transportation devices are important components that are used in for example micro pumps, atomizers, print heads or the industrial printers. Therefore, how to utilize an innovative structure to break through the bottleneck of the prior art has become an important part of development.

With the rapid advancement of science and technology, the application of fluid transportation device tends to be more and more diversified. For the industrial applications, the biomedical applications, the healthcare, the electronic cooling and so on, even the most popular wearable devices, the fluid transportation device is utilized therein. It is obviously that the conventional fluid transportation devices gradually tend to miniaturize the structure and maximize the flow rate thereof.

In the prior art, the fluid transportation device is mainly constructed by stacking the conventional mechanism components. Moreover, the miniaturization and thinning of the entire device are achieved by minimizing or thinning each mechanism component. However, while miniaturizing the structure of the conventional mechanism components, it is difficult to control the dimensional accuracy and the assembly accuracy. As a result, the product yield rate varies. Moreover, it even results in the fluid transportation becoming an unstable flow.

Furthermore, the conventional fluid transportation device also has the problem of insufficient transportation amount. It is difficult to meet the needs of transporting a lot of fluid by a single fluid transportation device. Moreover, the conventional fluid transportation devices usually have leading pins protruding outwardly for the purpose of power connection. If a plurality of conventional fluid transportation devices are arranged side by side to increase the transportation amount of fluid, it is difficult to control the assembly accuracy. The leading pins are likely to cause obstacles for assembling, and the power line provided for the external connection is too complicated to be set up. Therefore, it is still difficult to increase transportation amount of fluid by the prior art, and the arrangement cannot be applied flexibly.

Therefore, there is a need of providing a micro-electromechanical fluid control device to solve the above-mentioned drawbacks in prior arts. It makes the apparatus or the equipment utilizing the conventional fluid transportation device to achieve a small size, miniaturization, and mute. It also avoids the difficulty of controlling the dimensional accuracy and overcomes the problem of the insufficient flow rate. The present disclosure provides a micro fluidic transportation device to be flexibly applied to various apparatus or equipment.

SUMMARY OF THE DISCLOSURE

The object of the present disclosure is to provide a micro-electromechanical fluid control device. The miniaturized fluid control device is produced into one piece by a micro-electromechanical process. Thus, it overcomes the problem that the conventional fluid transportation device cannot have a small size, be miniaturized and avoid the difficulty of controlling the dimensional accuracy and the insufficient flow rate at the same time.

In accordance with an aspect of the present disclosure, there is provided a micro-electromechanical fluid control device including at least one flow guiding unit. Each flow guiding unit includes at least one inlet plate, at least one substrate, at least one resonance membrane, at least one actuating membrane, at least one piezoelectric membrane and at least one outlet plate. The inlet plate includes at least one inlet. The resonance membrane includes a suspension structure made by a surface micromachining process and includes at least one central aperture and a plurality of movable parts. At least one convergence chamber is defined by the resonance membrane and the inlet plate. The actuating membrane includes a hollow and suspension structure made by the surface micromachining process and includes at least one suspension part, at least one outer frame and at least one vacant space. The piezoelectric membrane is attached on a surface of the suspension part of the actuating membrane. The outlet plate includes at least one outlet. The inlet plate, the substrate, the resonance membrane, the actuating membrane and the outlet plate are sequentially stacked. At least one gap between the resonance membrane of the flow guiding unit and the actuating membrane of the flow guiding unit is formed as at least one first chamber, and at least one second chamber is formed between the actuating membrane and the outlet plate. While the piezoelectric membrane of the flow guiding unit drives the actuating membrane, at least one fluid is inhaled into the convergence chamber via the inlet of the inlet plate, transported into the first chamber via the central aperture of the resonance membrane, transported into the second chamber via the at least one vacant space, and discharged out from the outlet of the outlet plate, so as to control the fluid to flow.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
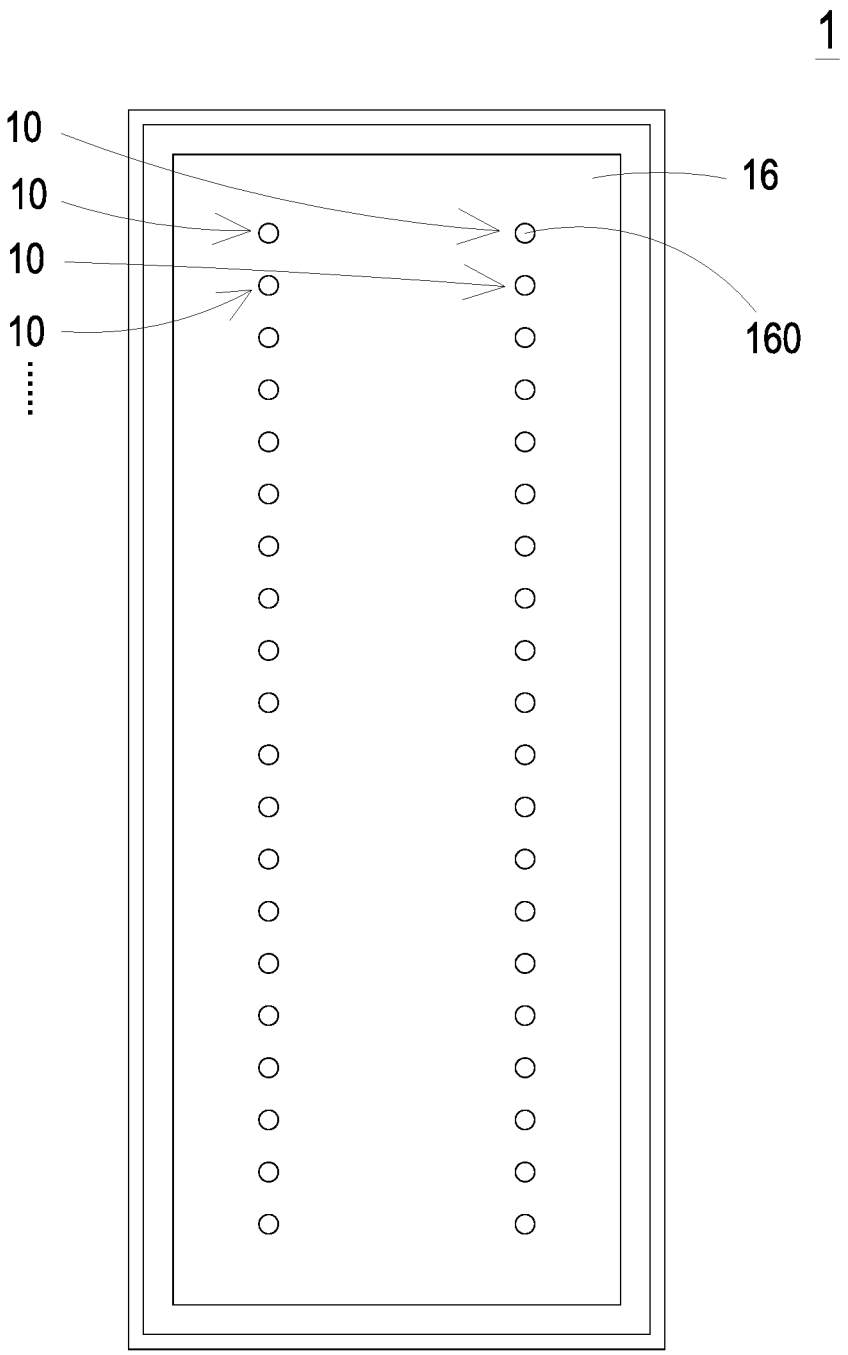
FIG. 1 is a schematic structural view illustrating a micro-electromechanical fluid control device according to a first embodiment of the present disclosure.
Figure 2:
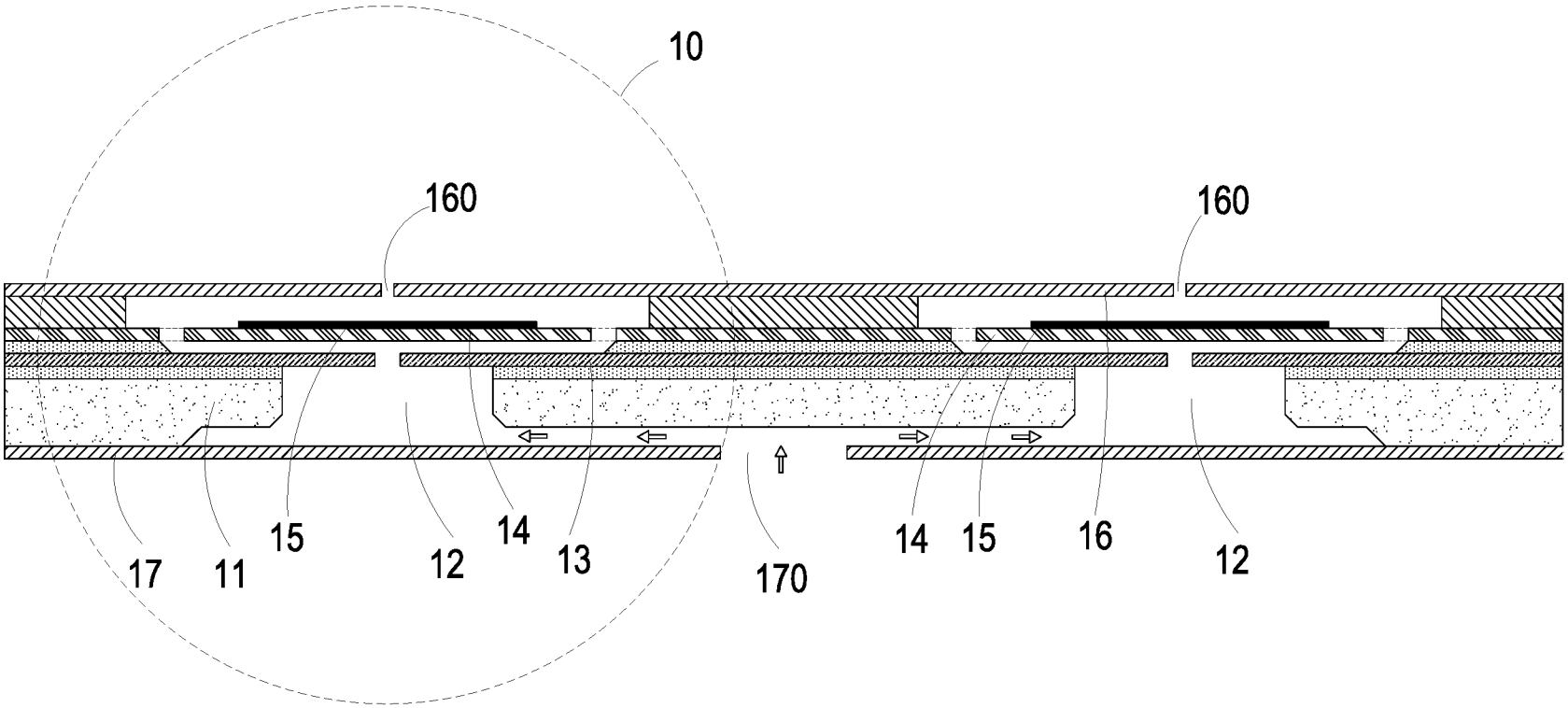
FIG. 2 is a schematic cross-sectional view illustrating the micro-electromechanical fluid control device of FIG. 1.
Figure 3A:
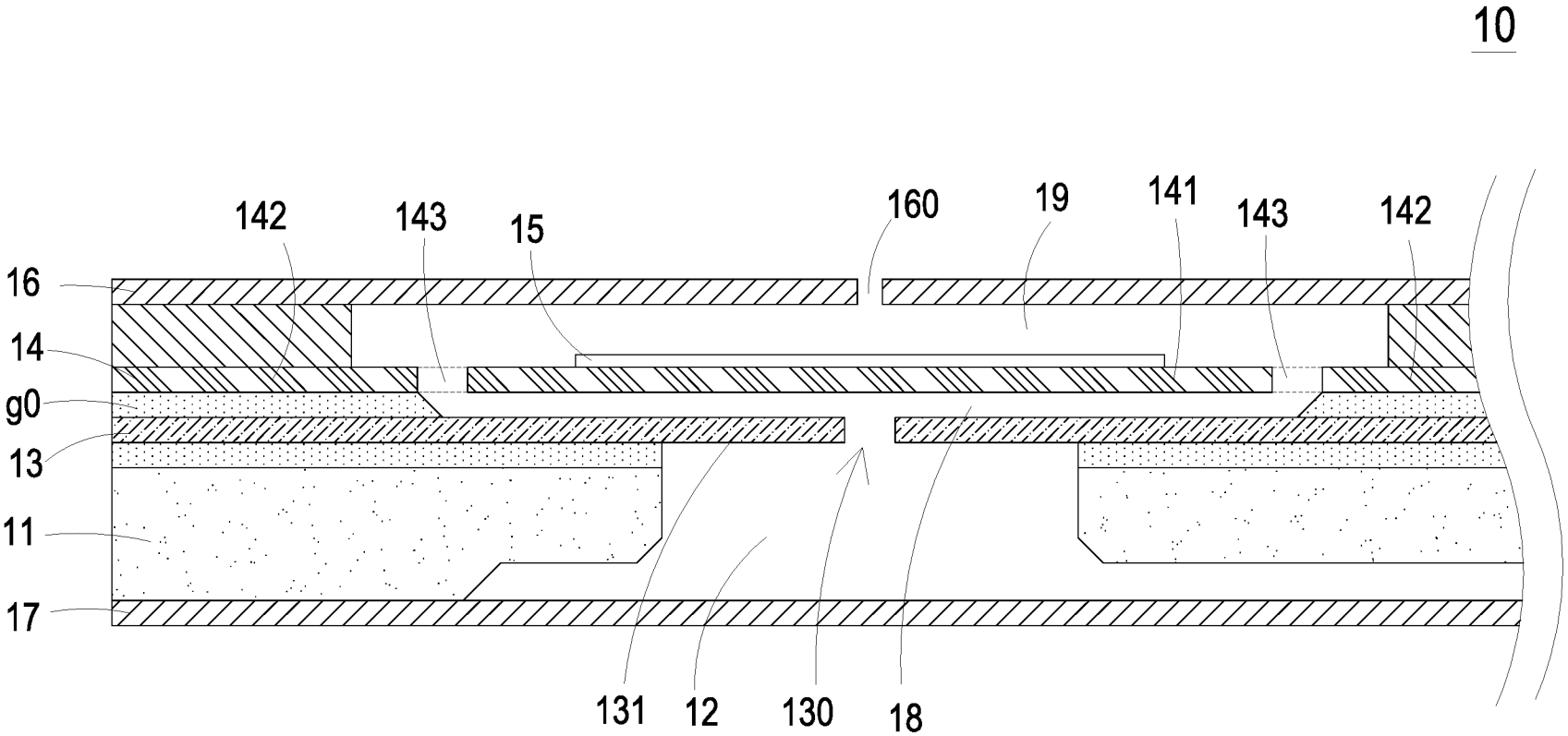
FIG. 3A is an enlarged cross-sectional view illustrating a partial structure of a single flow guiding unit of the micro-electromechanical fluid control device of FIG. 2.

Please refer to FIGS. 1, 2 and 3A. The present disclosure provides a micro-electromechanical fluid control device 1 including at least one flow guiding unit 10, at least one inlet plate 17, at least one inlet 170, at least one substrate 11, at least one resonance membrane 13, at least one central aperture 130, a plurality of movable parts 131, at least one convergence chamber 12, at least one actuating membrane 14, at least one suspension part 141, at least one outer frame 142, at least one vacant space 143, at least one piezoelectric membrane 15, at least one outlet plate 16, at least one outlet 160, at least one gap g0, at least one first chamber 18 and at least one second chamber 19. The numbers of the inlet plate 17, the substrate 11, the resonance membrane 13, the central aperture 130, the convergence chamber 12, the actuating membrane 14, the suspension part 141, the outer frame 142, the piezoelectric membrane 15, the outlet plate 16, the outlet 160, the gap g0, the first chamber 18 and the second chamber 19 are exemplified by one for each respectively in the following embodiments but not limited thereto. It is noted that each of the inlet plate 17, the substrate 11, the resonance membrane 13, the central aperture 130, the convergence chamber 12, the actuating membrane 14, the suspension part 141, the outer frame 142, the piezoelectric membrane 15, the outlet plate 16, the outlet 160, the gap g0, the first chamber 18 and the second chamber 19 can also be provided in plural numbers.

The micro-electromechanical fluid control device 1 is produced into one piece by a micro-electro-mechanical-system (MEMS) process, so as to overcome the problems that the conventional fluid transportation device cannot have a small size, be miniaturized and avoid the difficulty of controlling the dimensional accuracy and the insufficient flow rate at the same time. Please refer to FIGS. 1 and 2. FIG. 1 is a schematic structural view illustrating a micro-electromechanical fluid control device according to a first embodiment of the present disclosure. FIG. 2 is a schematic cross-sectional view illustrating the micro-electromechanical fluid control device of FIG. 1. In the embodiment, the micro-electromechanical fluid control device 1 is produced by a micro-electro-mechanical-system (MEMS) process. The surface of the material is micro-machined by means of dry and wet etching, so as to make an integrally formed miniature fluid control device. In this embodiment, the structure of the micro-electromechanical fluid control device 1 is disassembled for convenience of description and highlighting the features of the structure. However, this is not to describe the structure as a detachable structure. As shown in FIGS. 1 and 2, in the first embodiment, the micro-electromechanical fluid control device 1 is a rectangular flat structure, but not limited thereto. The micro-electromechanical fluid control device 1 includes the inlet plate 17, the substrate 11, the resonance membrane 13, the actuating membrane 14, the plurality of piezoelectric membrane 15 and the outlet plate 16 sequentially stacked. The inlet plate 17 includes at least one inlet 170. The resonance membrane 13 includes a central aperture 130 and a plurality of movable parts 131, and a convergence chamber 12 is formed between the resonance membrane 13 and the inlet plate 17 (as shown in FIG. 3A). The actuating membrane 14 includes a suspension part 141, an outer frame 142 and a plurality of vacant spaces 143 (as shown in FIG. 3A). The outlet plate 16 includes at least one outlet 160. The present disclosure is not limited thereto. Its structure, characteristics and disposing methods will be further described in the following paragraph. In the embodiment, the micro-electromechanical fluid control device 1 is all integrally formed by the micro-electro-mechanical-system (MEMS) process, and its size is small and thin. There is no need of stacking and machining the components as the conventional fluid control device does. The difficulty of controlling the dimensional accuracy is avoided, the quality of the completed product is stable and the yield rate is high.

In the embodiment, a plurality of inlets 170 of the inlet plate 17, a plurality of convergence chambers 12 of the substrate 11, a plurality of central cavities 130 and movable parts 131 of the resonance membrane 13, a plurality of suspension parts 141 and vacant spaces 143 of the actuating membrane 14, a plurality of piezoelectric membranes 15 and a plurality of outlets 160 of the outlet plate 16 collaboratively form a plurality of flow guiding units 10 of the micro-electromechanical fluid control device 1 includes. In other words, each flow guiding unit 10 includes one convergence chamber 12, one central aperture 130, one movable part 131, one suspension part 141, one vacant space 143, one piezoelectric membrane 15 and one outlet 160, and the plurality of flow guiding unit 10 share one inlet 170, but not limited thereto. A gap g0 defined between the resonance membrane 13 and the actuating membrane 14 in each flow guiding unit 10 forms the first chamber 18 (as shown in FIG. 3A). The second chamber 19 is formed between the actuating membrane 14 and the outlet plate 16 in each flow guiding unit 10 (as shown in FIG. 3A). In order to facilitate the description of the structure of the micro-electromechanical fluid control device 1 and the manner of fluid control, the following description will be made with a single flow guiding unit 10, but it is not limited to the present disclosure where there is only a single flow guiding unit 10. A plurality of flow guiding units 10 having the same structure may be utilized to construct the micro-electromechanical fluid control device 1, and the number thereof may be varied according to the practical requirements. In other embodiments of the present disclosure, each flow guiding unit 10 may also include one inlet 170, but not limited thereto.

As shown in FIG. 1, in the first embodiment, the micro-electromechanical fluid control device 1 includes a plurality of flow guiding units 10 and the number of the plurality of flow guiding units 10 is forty. Namely, the micro-electromechanical fluid control device 1 includes forty units for transporting fluid separately shown in FIG. 1. Each outlet 160 is corresponding to the single flow guiding unit 10. Twenty of the forty flow guiding units 10 are arranged in one row, and two rows are correspondingly arranged side by side, but not limited thereto. The number and the arrangement thereof can be varied according to the practical requirements.

Please refer to FIG. 2. The inlet plate 17 includes at least one inlet 170. Each inlet 170 is a through hole running through the inlet plate 17, so as to flow a fluid therethrough. In the embodiment, the number of the inlet 170 is one. In some embodiments, the number of the inlet 170 can be more than one, but not limited thereto. The number and the arrangement thereof can be varied according to the practical requirements. In other embodiments, the inlet plate 17 further includes a filter device (not shown), but not limited thereto. The filter device can be disposed to seal the inlet 170, so as to filter the dust in the gas or to filter the impurities in the fluid. Consequently, it prevents the impurities and the dust from flowing into the micro-electromechanical fluid control device 1 to damage the inner components thereof.

Please refer to FIGS. 2 and 3A. FIG. 3A is an enlarged cross-sectional view illustrating a partial structure of a single flow guiding unit of the micro-electromechanical fluid control device of FIG. 2. As shown in FIGS. 2 and 3A, in the embodiment, the substrate 11 of the flow guiding unit 10 is made by means of a silicon bulk micromachining process and includes a fluid-inlet structure with a high aspect ratio. Since the silicon has the mechanical properties and the Young's modulus similar to those of the steel, the yield strength twice higher than that of the steel, and the density equal to one-third of that of the steel, and the mechanical properties of the silicon is extremely stable, it is suitable to be applied in the dynamic microstructure of the present disclosure, but not limited thereto. The materials can be varied according to the practical requirements. In the embodiment, the substrate 11 further includes a driving circuit (not shown) electrically connected with the positive electrode and the negative electrode of the piezoelectric membrane 15, so as to provide the driving power, but not limited thereto. In some embodiments, the driving circuit can also be disposed at any position within the micro-electromechanical fluid control device 1. The present disclosure is not limited thereto and the disposed position can be varied according to the practical requirements.

Please refer to FIGS. 2 and 3A again. In the embodiment, the resonance membrane 13 of the micro-electromechanical fluid control device 1 includes a suspension structure made by a surface micromachining process. The resonance membrane 13 further includes a central aperture 130 and a plurality of movable parts 131. Each flow guiding unit 10 includes one central aperture 130 and one movable part 131 corresponding to the central aperture 130. In the embodiment, the central aperture 130 of the flow guiding unit 10 is located at the center of the movable part 131 and is a through hole, which runs through the resonance membrane 13 and is in communication between the convergence chamber 12 and the first chamber 18, so as to flow and transport the fluid therethrough. In the embedment, the movable part 131 is a structural part of the resonance membrane 13 and can be a flexible structure. In response to the upward and downward bending vibration of the movable part 131 actuated by the actuating membrane 14, the fluid can be transported. The actions thereof will be further described in the following.

Please refer to FIGS. 2 and 3A again. In the embodiment, the actuating membrane 14 of the micro-electromechanical fluid control device 1 is constructed by a metallic membrane or a polysilicon membrane, but not limited thereto. The actuating membrane 14 includes a hollow and suspension structure made by the surface micromachining process. The actuating membrane 14 further includes a suspension part 141 and an outer frame 142. Each flow guiding unit 10 includes one suspension part 141. In the flow guiding unit 10 of the embodiment, the suspension part 141 is connected to the outer frame 142 by a plurality of connection parts (not shown), so that the suspension part 141 is suspended and elastically supported by the outer frame 142. There are a plurality of vacant spaces 143 defined between the suspension part 141 and the outer frame 142, so as to flow the fluid. The arrangement, the types and the numbers of the suspension part 141, the out frame 142 and the vacant spaces 143 are varied according to the practical requirements, but not limited thereto. In some embodiments, the suspension part 141 includes a stepped structure. Namely, the suspension part 141 further includes a bulge (not shown). The bulge can be for example but not limited to a circular convex structure, and formed on the bottom surface of the suspension part 141. With the arrangement of the bulge, the depth of the first chamber 18 is maintained at a specific interval value. In this way, it is possible to avoid the problem that while the movable part 131 of the resonance membrane 13 is vibrated, the movable part 131 may collide the actuating membrane 14 to generate the noise due to the depth of the first chamber 18 being too small. Moreover, it also avoids the problem of insufficient fluid transportation pressure due to the depth of the first chamber 18 being too large. The present disclosure is not limited thereto.

Please refer to FIGS. 2 and 3A again. In the embodiment, each flow guiding unit 10 includes one piezoelectric membrane 15. The piezoelectric membrane 15 further includes a positive electrode and a negative electrode (not shown), so as to drive the actuating membrane 14. In the embodiment, the piezoelectric membrane 15 of the flow guiding unit 10 includes a metal oxide membrane made by a sol-gel process, but not limited thereto. The piezoelectric membrane 15 is attached on the top surface of the suspension part 141 of the actuating membrane 14, so as to drive the actuating membrane 14 to vibrate along a vertical direction in a reciprocating manner and drive the resonance membrane 13 to vibrate in resonance. In this way, a pressure gradient occurs in first chamber 18 between the resonance membrane 13 and the actuating membrane 14 so as to transport the fluid. The actions thereof will be further described in the following.

Please refer to FIGS. 1, 2 and 3A again. In the embodiment, the outlet plate 16 of the micro-electromechanical fluid control device 1 further includes at least one outlet 160. Each flow guiding unit 10 includes one outlet 160. In the flow guiding unit 10 of the embodiment, the outlet 160 is in fluid communication between the second chamber 19 and the outside of the outlet plate 16, and the fluid flows from the second chamber 19 to the outside of the outlet plate 16 through the outlet 160 so as to achieve fluid transportation. In some embodiments, the outlet plate 16 of the flow guiding unit 10 further includes a check valve (not shown). The check valve is disposed to seal the outlet 160 and is opened or closed according to the pressure change of the second chamber 19, but not limited thereto. Thus, it prevents the fluid from flowing into the second chamber 19 from the outside. In other embodiments, the outlet plate 16 of the flow guiding unit 10 further includes a filtering device (not shown). The filtering device can be disposed to seal the outlet 160, so as to filter the dust in the gas, or filter the impurities in the fluid. Consequently, it prevents the dust and the impurities from flowing into the micro-electromechanical fluid control device 1 to damage the inner components thereof.

Please refer to FIGS. 3A to 3E. FIG. 3B to 3E are cross-sectional views illustrating processing actions of the single flow guiding unit of the micro-electromechanical fluid control device of FIG. 3A. Firstly, the flow guide unit 10 of the micro-electromechanical fluid control device 1 shown in FIG. 3A is in a disable state (i.e., an initial state). There is a gap g0 formed between the resonance membrane 13 and the actuating membrane 14 so that the depth between the resonance membrane 13 and the suspension part 141 of the actuating membrane 14 can be maintained as the gap g0. Thus, the fluid can be transported more rapidly, and the contact interference between the suspension part 141 and the resonance membrane 13 can be reduced by maintaining a proper distance therebetween. The generated noise can be largely reduced, but the present disclosure is not limited thereto.

Figure 3B:
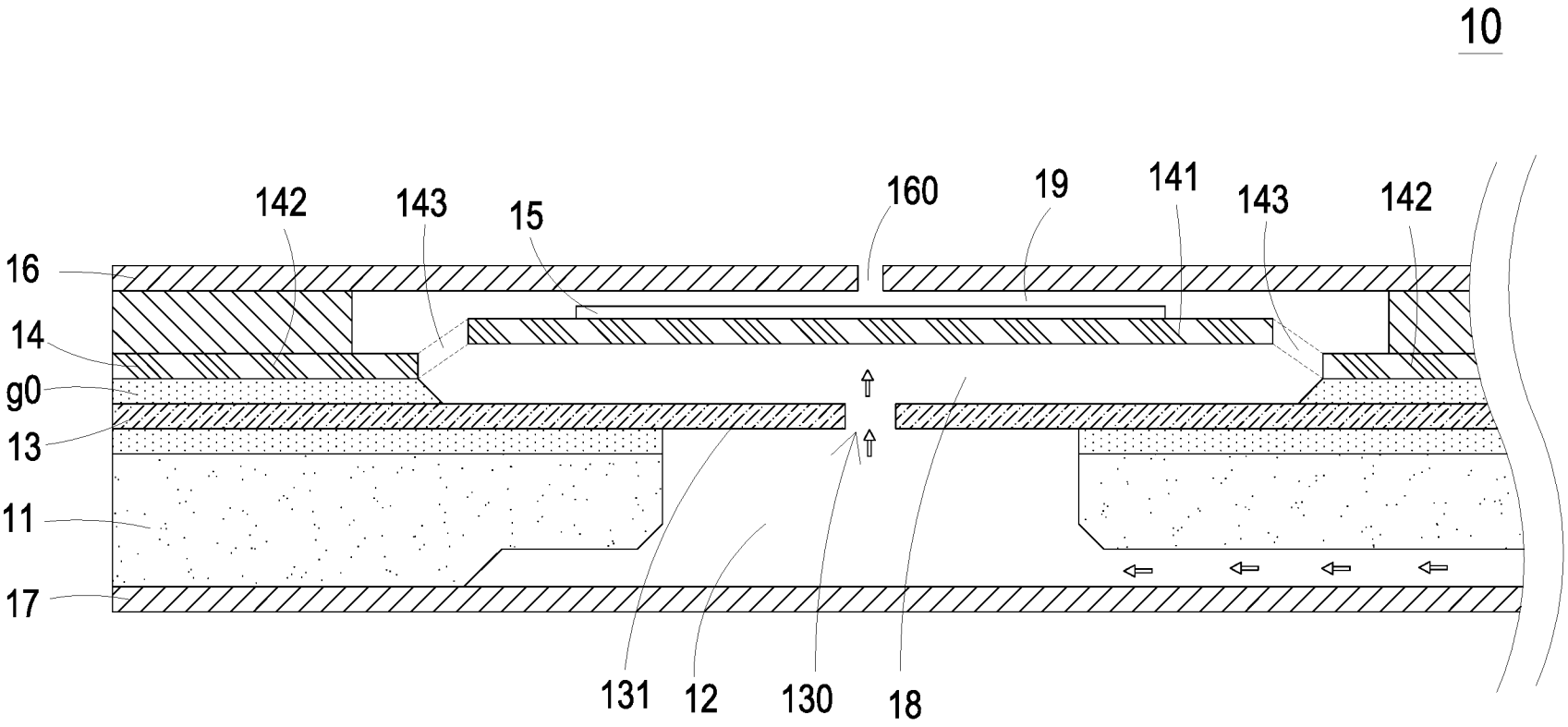
FIG. 3B to 3E are cross-sectional views illustrating processing actions of the single flow guiding unit of the micro-electromechanical fluid control device of FIG. 3A.

As shown in FIGS. 2 and 3B, in the flow guiding unit 10, when the actuating membrane 14 is actuated by the piezoelectric membrane 15, the suspension part 141 of the actuating membrane 14 vibrates upwardly to enlarge the volume of the first chamber 18 and reduce the pressure. Thus, the fluid is inhaled via the inlet 170 of the inlet plate 17 in accordance with the external pressure and collected into the convergence chamber 12 of the substrate 11. Afterward, the fluid flows upwardly into the first chamber 18 via the central aperture 130 of the resonance membrane 13 relative to the convergence chamber 12.

Figure 3C:
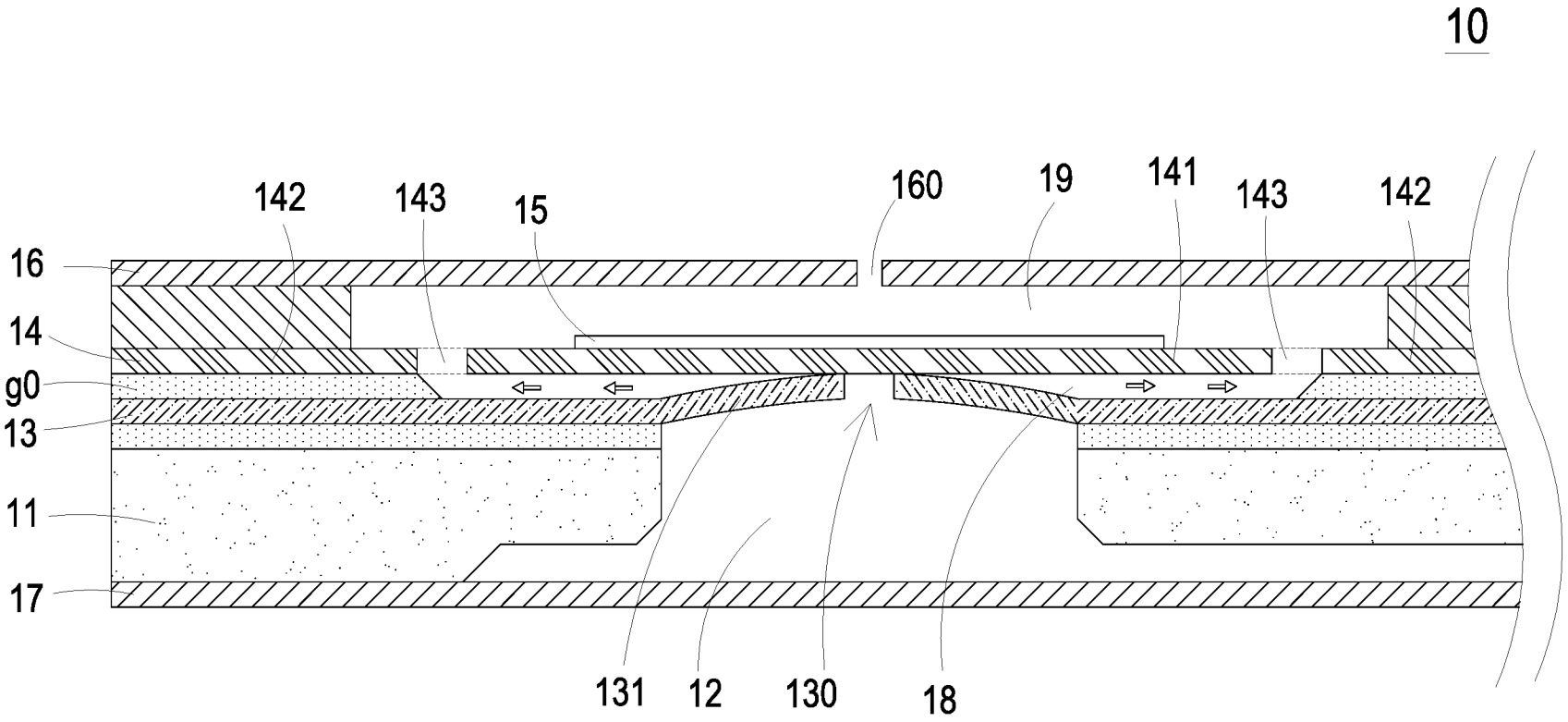

Then, as shown in FIGS. 2 and 3C, due to the vibration of the suspension part 141 of the actuating membrane 14, the movable part 131 of the resonance membrane 13 is driven to vibrate upwardly in resonance, and the suspension part 141 of the actuating membrane 14 also vibrates downwardly at the same time. Consequently, the movable part 131 of the resonance membrane 13 is attached to the suspension part 141 of the actuating membrane 14 and the flowing space of the first chamber 18 is closed simultaneously. Thus, the first chamber 18 is compressed to reduce the volume and increase the pressure, and the second chamber 19 is increased in volume and decreased in pressure. Under this circumstance, the pressure gradient occurs to push the fluid in the first chamber 18 moving toward to peripheral regions and flowing into the second chamber 19 through the plurality of vacant spaces 143 of the actuating membrane 14.

Figure 3D:
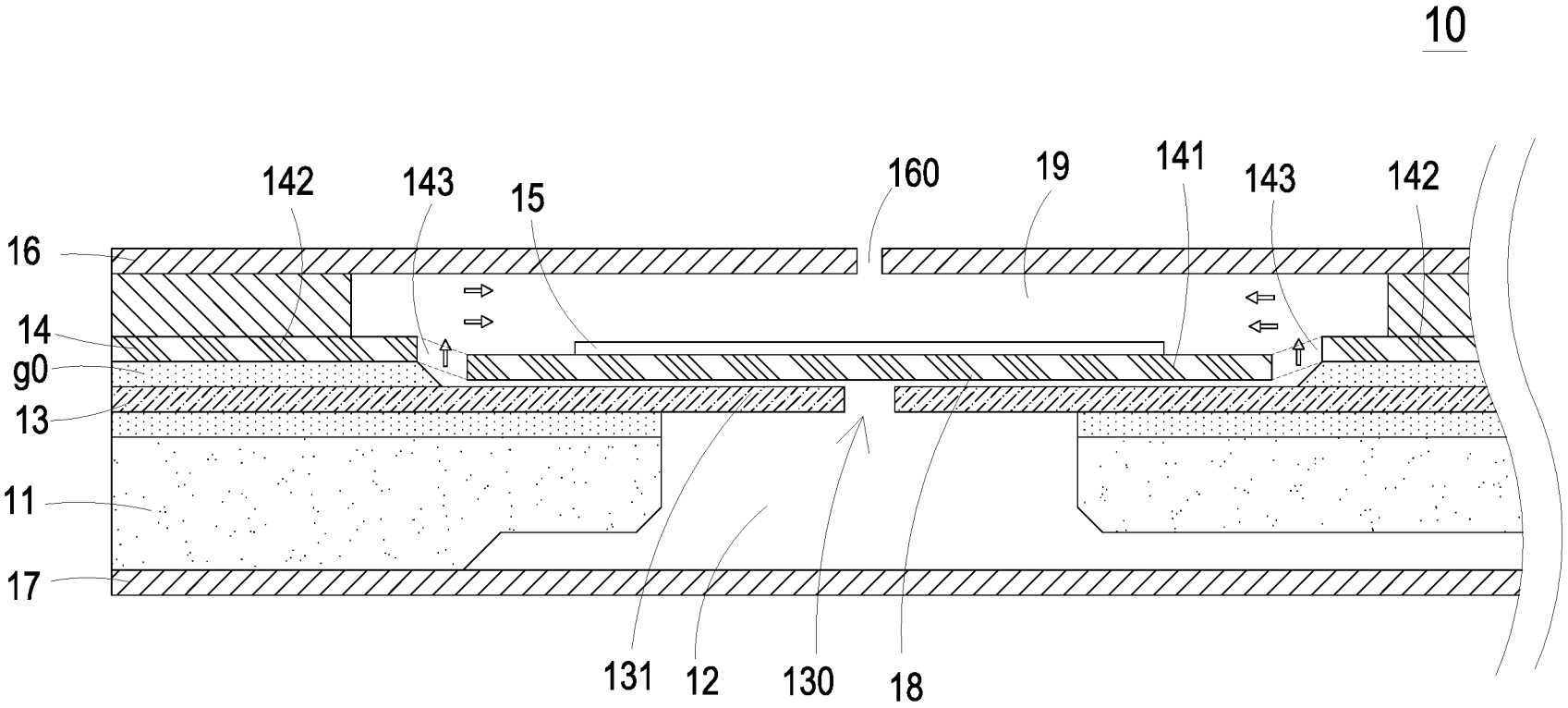

Furthermore, as shown in FIGS. 2 and 3D, the suspension part 141 of the actuating membrane 14 vibrates downwardly and drives correspondingly the movable part 131 of the resonance membrane 13 to vibrate downwardly, so as to compress the first chamber 18 continuously. Most of the fluid is transported into the second chamber 19 and temporarily stored, so as to allow a lot of fluid to be discharged in the next step.

Figure 3E:
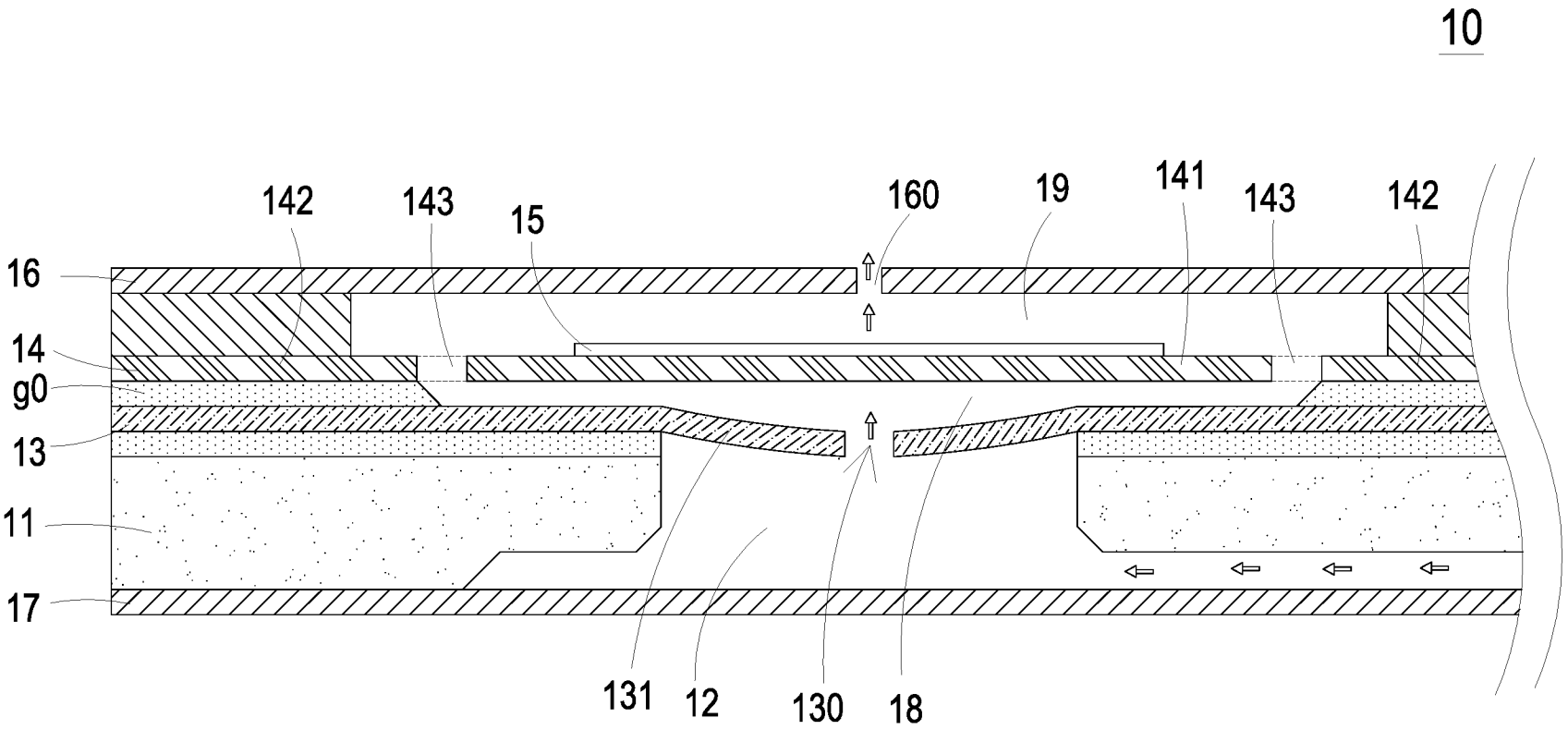

At last, as shown in FIGS. 2 and 3E, the suspension part 141 of the actuating membrane 14 vibrates upwardly to compress the second chamber 19 to reduce the volume and increase the pressure thereof. The fluid in the second chamber 19 is discharged out of the outlet plate 16 from the outlet 160 of the outlet plate 16, so as to accomplish the fluid transportation. Since the suspension part 141 of the actuating membrane 14 vibrates upwardly and the movable part 131 of the resonance membrane 13 vibrates downwardly at the same time, the volume of the first chamber 18 is increased and the pressure thereof is reduced. Consequently, the fluid is inhaled via the inlet 170 of the inlet plate 17 in accordance with the external pressure, collected into the convergence chamber 12 of the substrate 11 and flowing upwardly into the first chamber 18 via the central aperture 130 of the resonance membrane 13 relative to the convergence chamber 12. Repeating the above described processing actions of the flow guiding unit 10 in FIGS. 3B to 3E, the suspension part 141 of the actuating membrane 14 and the movable part 131 of the resonance membrane 13 continuously vibrate upwardly and downwardly in a reciprocating manner, and the fluid can be continuously introduced into the inlet 170 and transported toward the outlet 160, so as to accomplish the fluid transportation.

In this way, the pressure gradient is generated in the designed flow channels of each flow guiding unit 10 of the micro-electromechanical fluid control device 1 to flow the fluid at a high speed. Moreover, since there is an impedance difference between the feeding direction and the exiting direction, the fluid can be transported from the inlet side to the outlet side. Even if a gas pressure exists at the outlet side, the capability of pushing the fluid is maintained while achieving the silent efficacy. In some embodiments, the vertical reciprocating vibration frequency of the resonance membrane 13 may be the same as the vibration frequency of the actuating membrane 14. Namely, both of the resonance membrane 13 and the actuating membrane 14 may be moved upwardly or downwardly at the same time. The processing actions can be adjustable according to the practical requirements, but not limited to that of the embodiments.

In the embodiment, the micro-electromechanical fluid control device 1 includes forty flow guiding units 10, which can be in accordance with the design of the multiple arrangement modes and the connection of the drive circuit. The flexibility of the micro-electromechanical fluid control device 1 is extremely high, and is more applicable to various electronic components. The forty flow guiding units 10 can be enabled simultaneously to transport the fluid, so as to meet the fluid transportation requirements at a large flow rate. In addition, each flow guiding unit 10 can also be individually controlled to actuate or stop. For example, a part of the flow guiding units 10 are actuated and the other part of the flow guiding units 10 are stopped. Alternatively, it is also possible that a part of the flow guiding units 10 and the other part of the flow guiding units 10 are operated alternately, but not limited thereto. Thus, it facilitates to meet various fluid transportation requirements easily and achieve a significant reduction in power consumption.

Figure 4:
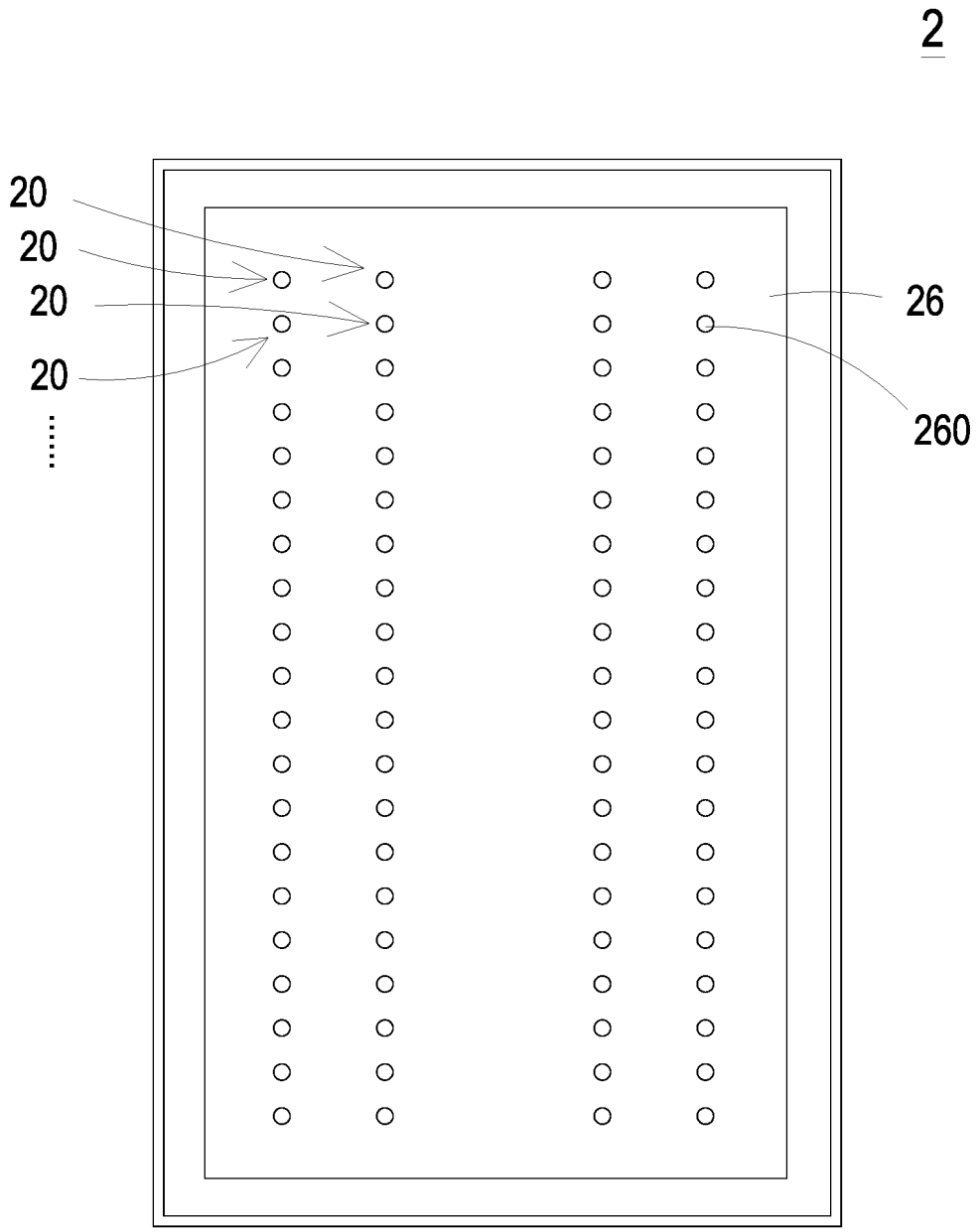
FIG. 4 is a schematic structural view illustrating a micro-electromechanical fluid control device according to a second embodiment of the present disclosure.

Please refer to FIG. 4. FIG. 4 is a schematic structural view illustrating a micro-electromechanical fluid control device according to a second embodiment of the present disclosure. In the second embodiment, the micro-electromechanical fluid control device 2 includes a plurality of flow guiding units 20 and the number of the plurality of flow guiding units 20 is eighty. Each outlet 260 of the outlet plate 26 is corresponding to a single flow guiding unit 20. In other words, the micro-electromechanical fluid control device 2 includes eighty flow guiding units 20, and each of the flow guiding units 20 can be controlled individually to flow the fluid. The structure of each flow guiding unit 20 is similar to that of the foregoing first embodiment, and the difference is only in the number and the arrangement thereof. The structure thereof will not be redundantly described herein. In the embodiment, twenty of the eighty flow guiding units 20 are also arranged in one row and four rows are correspondingly arranged side by side, but not limited thereto. The number and the arrangement of the eighty flow guiding units 20 can be varied according to the practical requirements. By enabling the eighty flow guiding units 20 to transport the fluid at the same time, it can achieve a greater fluid transportation amount than the previous embodiment. Moreover, each flow guiding unit 20 can also individually enable to flow the fluid, and it facilitates to control the fluid transportation amount in a wider range. It is more flexible and applicable to all types of apparatuses required a large flow of fluids, but not limited thereto.

Figure 5:
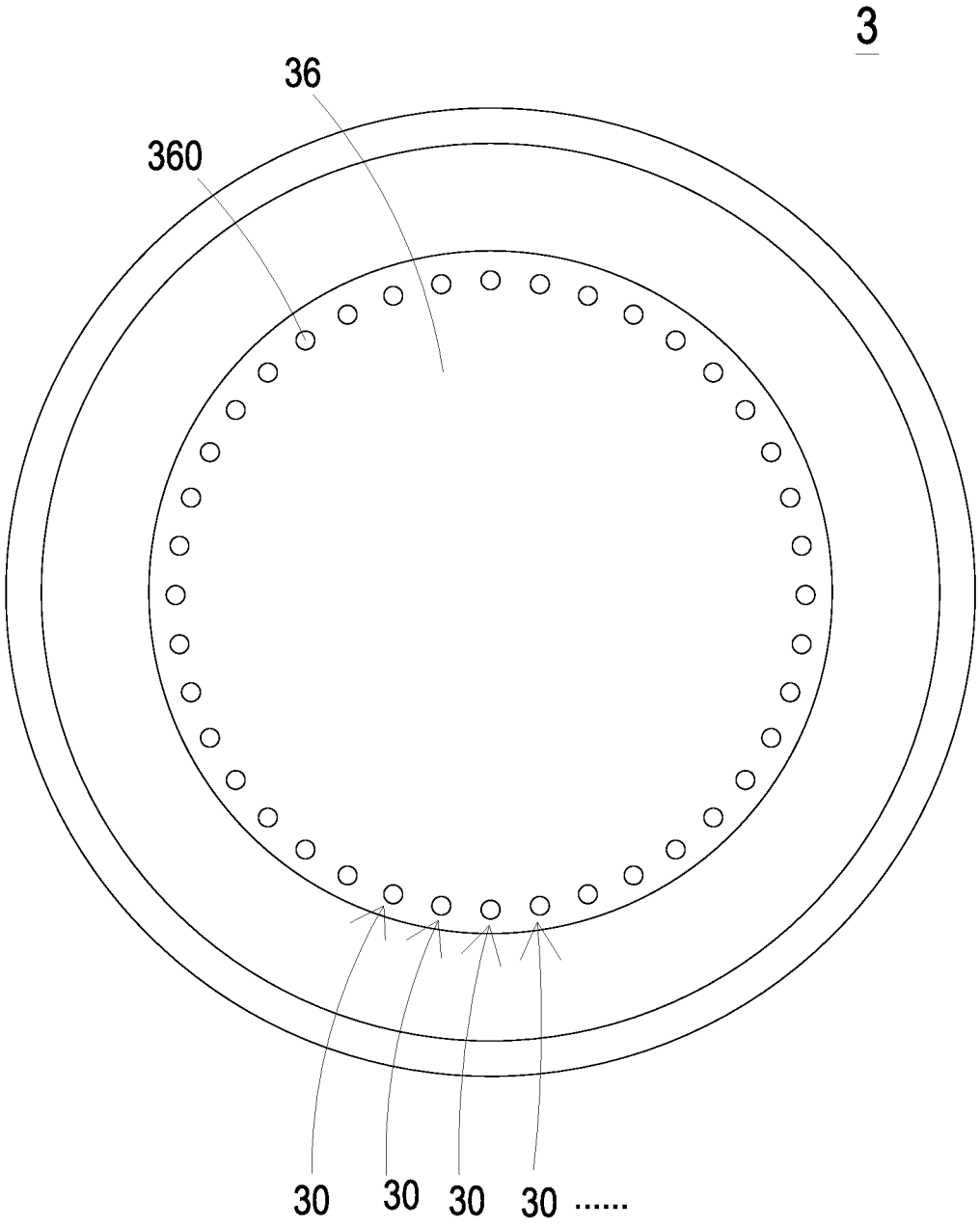
FIG. 5 is a schematic structural view illustrating a micro-electromechanical fluid control device according to a third embodiment of the present disclosure.

Please refer to FIG. 5. FIG. 5 is a schematic structural view illustrating a micro-electromechanical fluid control device according to a third embodiment of the present disclosure. In the third embodiment, the micro-electromechanical fluid control device 3 includes a circular structure and forty flow guiding units 30. Each outlet 360 of the outlet plate 36 is corresponding to a single flow guiding unit 30. In other words, the micro-electromechanical fluid control device 3 includes forty flow guiding units 30, and each of the flow guiding units 30 can be controlled individually to flow the fluid. The structure of each flow guiding unit 30 is similar to that of the foregoing first embodiment, and the difference is only in the number and the arrangement thereof. The structure thereof will not be redundantly described herein. In the embodiment, the forty flow guiding units 30 are arranged in an annular manner, so as to be applied in various round or circular fluid transportation channels. By changing the arrangement of the flow guiding units 30, it facilitates to meet various shapes of the desired devices and be more flexible and applicable to various fluid transportation devices. In other embodiments, the plurality of the flow guiding units 30 can be arranged in a honeycomb pattern manner (not shown), but not limited thereto.

In summary, the present disclosure provides a micro-electromechanical fluid control device, which is produced into one piece by a micro-electro-mechanical-system (MEMS) process. It facilitates to achieve the effects of minimizing the volume and thinning. There is no need of stacking and machining the components as the conventional fluid control device does. The difficulty of controlling the dimensional accuracy is avoided, the quality of the completed product is stable and the yield rate is high. In addition, with the actions of driving the actuating membrane by the piezoelectric membrane, a pressure gradient is generated in the designed flow channels and the compressed chambers, so as to facilitate the fluid to flow at a high speed. The fluid is transported from the inlet side to the outlet side to accomplish the fluid transportation. Furthermore, the number, the arrangement and the driving modes of the flow guiding units can be varied flexibly according to the practical requirements of various fluid transportation apparatuses and the fluid transportation amount. It facilitates to achieve the high transportation volume, the high performance and the high flexibility.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A micro-electromechanical fluid control device comprising: a plurality of flow guiding units, wherein each of the flow guiding units comprises: an inlet plate comprising at least one inlet; a substrate; a resonance membrane comprising a suspension structure made by a surface micromachining process and comprising a central aperture and a plurality of movable parts, wherein a convergence chamber is formed between the resonance membrane and the inlet plate; an actuating membrane comprising a suspension structure made by the surface micromachining process and comprising a suspension part, an outer frame and at least one vacant space; a piezoelectric membrane attached on a surface of the suspension part of the actuating membrane; and an outlet plate comprising at least one outlet; wherein the inlet plate, the substrate, the resonance membrane, the actuating membrane and the outlet plate are sequentially stacked, a gap between the resonance membrane of the flow guiding unit and the actuating membrane of the flow guiding unit is formed as a first chamber, and a second chamber is formed between the actuating membrane and the outlet plate, wherein while the piezoelectric membrane of the flow guiding unit drives the actuating membrane, a fluid is inhaled into the convergence chamber via the inlet of the inlet plate, transported into the first chamber via the central aperture of the resonance membrane, transported into the second chamber via the at least one vacant space, and discharged out from the outlet of the outlet plate, so as to control the fluid to flow, wherein the plurality of flow guiding units of the micro-electromechanical fluid control device are all integrally formed into one piece structure made by micro-electro-mechanical-system process, and a surface of a material of the substrate of the plurality of flow guiding units is micro-machined by means of dry and wet etching, wherein the plurality of flow guiding units are connected by the substrate to form the resonance membrane and the actuating membrane.

2. The micro-electromechanical fluid control device according to claim 1, wherein the actuating membrane comprises a metallic membrane or a polysilicon membrane.

3. The micro-electromechanical fluid control device according to claim 1, wherein the piezoelectric membrane comprises a metal oxide membrane made by a sol-gel process.

4. The micro-electromechanical fluid control device according to claim 1, wherein the piezoelectric membrane comprises a positive electrode and a negative electrode to drive the actuating membrane to actuate.

5. The micro-electromechanical fluid control device according to claim 1, wherein the number of the plurality of flow guiding units is forty, wherein twenty of the plurality of flow guiding units are arranged in one row and two rows are correspondingly arranged side by side.

6. The micro-electromechanical fluid control device according to claim 1, wherein the number of the plurality of flow guiding units is eighty, wherein twenty of the plurality of flow guiding units are arranged in one row and four rows are correspondingly arranged side by side.

7. The micro-electromechanical fluid control device according to claim 1, wherein the plurality of flow guiding units are arranged in an annular manner.

8. The micro-electromechanical fluid control device according to claim 1, wherein the plurality of flow guiding units are arranged in a honeycomb pattern manner.

* * * * *